US007741777B2

(12) United States Patent
Adachi et al.

(10) Patent No.: US 7,741,777 B2
(45) Date of Patent: Jun. 22, 2010

(54) DISPLAY PANEL AND MANUFACTURING METHOD OF THE DISPLAY PANEL

(75) Inventors: Akinao Adachi, Chuo (JP); Shigenori Murakami, Chuo (JP); Kiyoshi Shimomura, Chuo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 326 days.

(21) Appl. No.: 11/905,894

(22) Filed: Oct. 5, 2007

(65) Prior Publication Data

US 2008/0180021 A1 Jul. 31, 2008

(30) Foreign Application Priority Data

Jan. 30, 2007 (JP) ..... 2007-018834

(51) Int. Cl.
*H01J 17/49* (2006.01)
*H01J 9/12* (2006.01)

(52) U.S. Cl. ..... 313/582; 313/583; 313/584; 313/585; 313/587

(58) Field of Classification Search ..... 313/582–587; 445/14, 24, 25; 315/169.3, 169.4; 345/30, 345/37

See application file for complete search history.

(56) References Cited

U.S. PATENT DOCUMENTS

2005/0104519 A1* 5/2005 Jeon ..... 313/582
2005/0116643 A1* 6/2005 Chang et al. ..... 313/582

FOREIGN PATENT DOCUMENTS

JP 2005-224733 8/2005

* cited by examiner

*Primary Examiner*—Bumsuk Won
*Assistant Examiner*—Elmito Breval
(74) *Attorney, Agent, or Firm*—Kratz, Quintos & Hanson, LLP

(57) ABSTRACT

A PDP includes a guide partition (127) that extends substantially along a center line F between a pair of first partitions (125) at a position spaced apart from an end of the nearest first partition (125) by a distance H. In a phosphor forming step, a phosphor paste is initially applied on the guide partition (127) by a nozzle (200), which has been located above the guide partition (127). Then, the nozzle (200) is moved to provide a phosphor layer whose end is formed on the guide partition (127).

10 Claims, 12 Drawing Sheets

DISPLAY PANEL AND MANUFACTURING METHOD OF THE DISPLAY PANEL

BACKGROUND OF THE INVENTION

1. Field of the Invention

The present invention relates to a display panel and a manufacturing method of the display panel.

2. Description of Related Art

Conventionally, a plasma display panel (PDP) has been configured by: disposing a pair of planar substrates to face each other with a discharge space interposed therebetween; partitioning the discharge space into a plurality of discharge cells by providing a curb-shaped or striped partition on an inner surface of one of substrates; and providing the partitioned portions with phosphor layers exemplarily of red, blue and green. The PDP displays images by selectively discharging inside the discharge cells for light emitting. As a method for forming the phosphor layer in the PDP, there has been know a dispense method, with which a phosphor material is injected to between the partitions using, for example, a nozzle (e.g. see Document: JP-A-2005-224733).

According to Document, using an application device that includes an ejecting head for performing the dispense method, a phosphor paste is ejected to a to-be-applied object with a masking tape attached in advance to both rib ends of a PDP rear substrate, thereby filling predetermined cells.

When the phosphor paste is applied to the substrate by the dispense method, it is desirable that a starting end of an application position is located immediately below a nozzle (ejecting head) ejecting the phosphor paste and that an application position is continuously located immediately below the nozzle thereafter.

However, in the arrangement disclosed in Document, the application starting end of the phosphor paste may be dislocated from the position immediately below the nozzle and the application position thereafter may be misaligned from a desirable position before the phosphor paste reaches the substrate from the nozzle due to a disturbance factor such as static electricity, air stream and the like or due to a variation of ejecting speed caused by an irregularity in an processing accuracy of the nozzle inside. In addition, in a case of multiple nozzles are used, the application position may be misaligned due to an influence of the phosphor paste ejected by a neighboring nozzle.

In order to solve the above problems, such methods have been known as to perform a control to approximate the nozzle toward the substrate such that the phosphor bridges between the nozzle and the substrate quickly at the starting end, or as to increase an ejecting amount by increasing an applying pressure only for the starting end. The methods utilize a characteristic where the application position is stabilized once the phosphor paste ejected from the nozzle bridges between the nozzle and the substrate.

However, such methods may require a device to perform a complex control.

In addition, it is highly difficult to correct a position other than a height position (i.e., a position in a right-and-left direction) in an application area other than the starting end.

SUMMARY OF THE INVENTION

In light of the above-described problems, an object of the present invention is to provide a display panel and a manufacturing method of the display panel that can enhance accuracy in applying a phosphor paste.

A display panel according to an aspect of the present invention includes: a pair of substrates disposed to face each other with a discharge space being interposed; partitions that partition the discharge space into display cells, the partitions being provided to at least one of the pair of substrates to be longitudinally formed between ends of the at least one of the pair of substrates; and a phosphor layer that emits light due to discharge in the discharge space, the phosphor layer being formed between the partitions, in which a display area in which images are displayed by light emitting of the phosphor layer due to the discharge is provided in an in-plane side of the at least one of the substrates while a non-display area is provided at a peripheral end of the at least one of the substrates, each of the partitions includes: a first partition that partitions the discharge space in a first direction; and a second partition that partitions the discharge space in a second direction substantially perpendicular to the first direction, a guide partition is provided at a position spaced apart by a predetermined distance from an end of each of the partitions provided at positions corresponding to the non-display area, the guide partition being positioned on a center line between the first partitions, and an end of the phosphor layer is provided on the guide partition.

A manufacturing method of a display panel according to another aspect of the present invention includes: a partition forming step to provide partitions that partition a discharge space into display cells to at least one of a pair of substrates disposed to face each other with the discharge space being interposed, the partitions being longitudinally formed between ends of the at least one of the pair of substrates; and a phosphor layer forming step to provide a phosphor layer between the partitions provided in the partition forming step, in which a display area in which images are displayed by light emitting of the phosphor layer due to discharge is provided in an in-plane side of the at least one of the substrates while a non-display area is provided at a peripheral end of the at least one of the substrates, the non-display area including a first non-display area and a second display area that are disposed with the display area being interposed, in the partition forming step, a first partition, a second partition and a guide partition are formed, the first partition partitioning the discharge space in a first direction, the second partition partitioning the discharge space in a second direction perpendicular to the first direction are formed, the guide partition being positioned at a position spaced apart by a predetermined distance from an end of each of the partitions provided at positions corresponding to the non-display area, the guide partition being positioned on a center line between the first partitions, and in the phosphor layer forming step, an application of a phosphor paste using a nozzle is started from above the guide partition, and the phosphor paste is continuously applied along a center line between the first partitions.

DETAILED DESCRIPTION OF PREFERRED EMBODIMENT(S)

First Embodiment

A first embodiment of the present invention will be described below with reference to the attached drawings.

[Arrangement of PDP]

Figure 1:
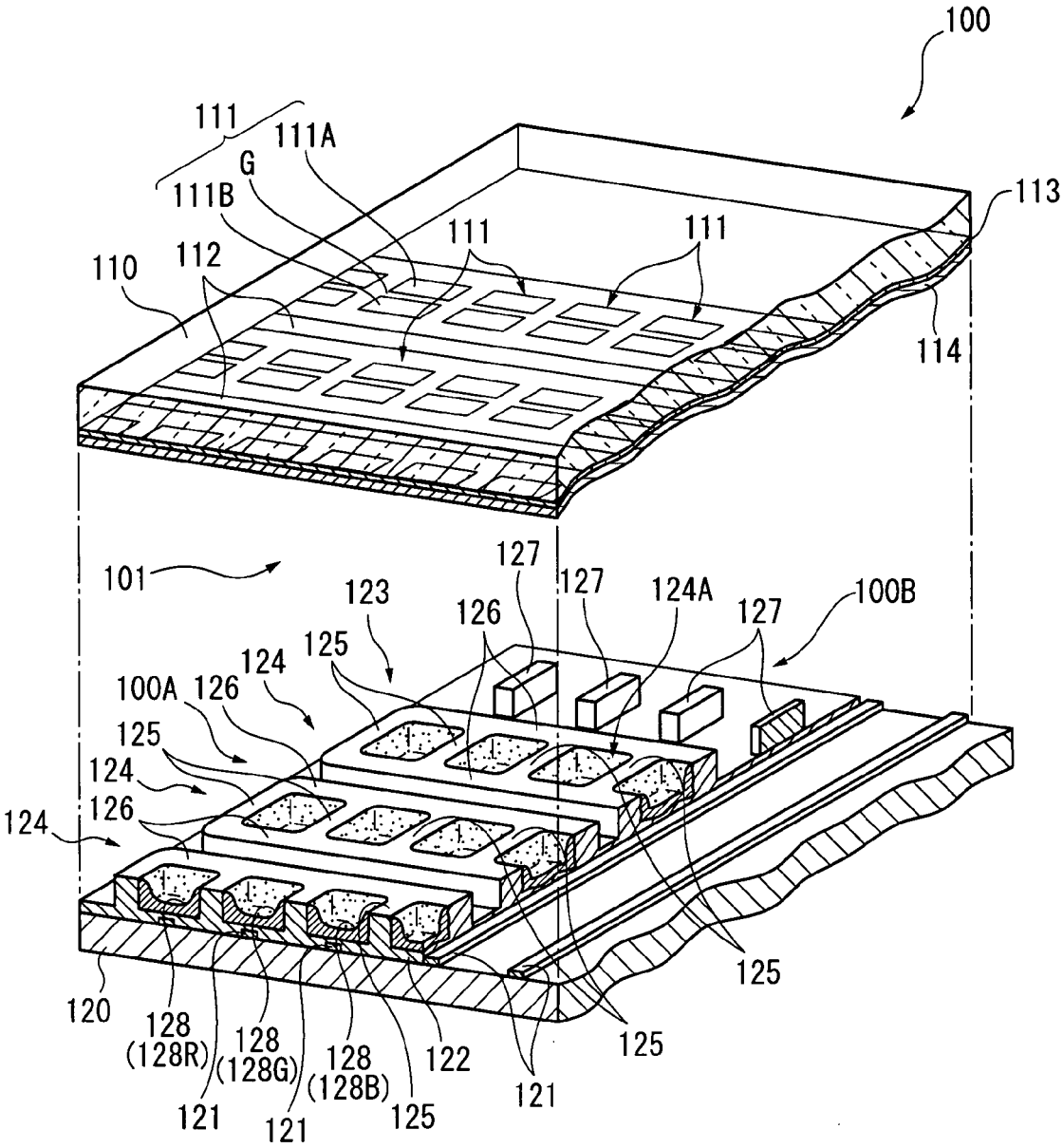
FIG. 1 is a perspective view showing a substrate of a plasma display panel according to a first embodiment of the present invention.
Figure 2:
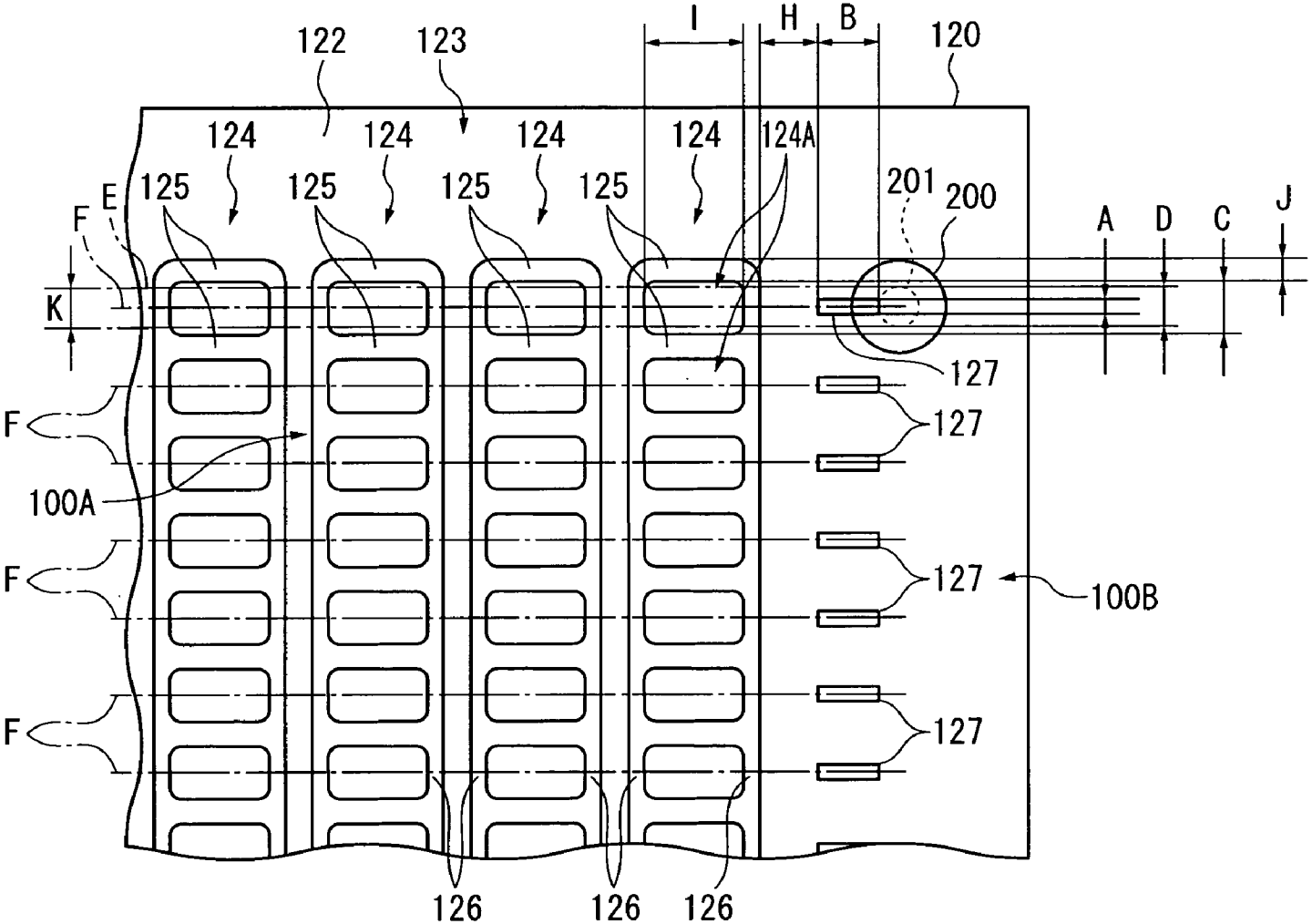
FIG. 2 is a plan view showing a vicinity of an end of a rear substrate according to the first embodiment.

FIG. 1 is a perspective view showing a substrate of a plasma display panel according to a first embodiment. FIG. 2 is a plan view showing a vicinity of an end of a rear substrate according to the first embodiment.

In FIG. 1, the numeral 100 refers to a plasma display panel serving as a display panel, and the plasma display panel (PDP) 100 is shaped in a substantially rectangular plate. In an in-plane side of the PDP 100 is provided a display area 100A that emits light due to discharge and displays a predetermined image. At a peripheral end of the display area 100A in an out-of-plane direction is provided a non-display area 100B where no image is displayed.

As shown in FIG. 1, in the PDP 100, a front substrate 110 and a rear substrate 120 are disposed to face each other with a discharge space provided therebetween.

In an inner side of the front substrate 110, a plurality of display electrodes 111, a plurality of black stripes 112, a dielectric layer 113 and a protective layer 114 are provided.

Specifically, the display electrode 111 includes: plural pairs of transparent electrodes 111A, 111B that face each other with a discharge gap G therebetween; and a pair of linear bus electrodes (not shown) laminated on one ends of the transparent electrodes 111A, 111B. The transparent electrodes 111A, 111B are each a transparent conductive film that is formed of, for example, ITO (Indium Tin Oxide) or the like, and each pair of transparent electrodes 111A, 111B is provided to correspond to a discharge cell serving as a predetermined display cell.

The bus electrodes, which are linearly formed of, for example, Ag (silver) or the like, are laminated on the ends of the pair of transparent electrodes 111A, 111B, the ends being on sides opposite to the discharge gap G. One ends of the bus electrodes are provided with bus electrode leading portions (not shown), through which a voltage pulse from a row electrode driver (not shown) is applied to the transparent electrodes 111A, 111B.

The black stripe 112 is linearly formed of, for example, a black inorganic pigment or the like. The black stripe 112 absorbs visible light irradiated from the outside of the front substrate 110.

The dielectric layer 113, which is formed of, for example, a dielectric paste or the like, is arranged to face an address-electrode dielectric layer 122 of the rear substrate 120. When the panel is driven, the dielectric layer 113 prevents the display electrodes 12 from being damaged by the discharge panel and accumulates electric charges required for the drive.

The protective layer 114, which is a transparent layer that is formed of MgO (magnesium oxide) by vapor deposition, sputtering or the like, covers the entire inner surface of the dielectric layer 113. The protective layer 114 prevents the dielectric layer 113 from being sputtered due to the discharge while serving as a discharge layer of a secondary electron for generating the discharge at a low voltage.

The rear substrate 120, which is a rectangular glass plate, includes address electrodes 121, the address-electrode dielectric layers 122, partition layers 123, phosphor layers 128 and the like.

The address electrode 121 is provided in plurality in parallel to, for example, a width direction of the rear substrate 120, thereby forming zonal patterns. The address electrode 121 is formed of, for example, a thin film of Aluminum (Al) by photolithography or the like. In addition, both ends of the address electrode 121 are provided with a leading electrode (not shown) for guiding a predetermined signal to the address electrode 121, the leading electrode being drawn outward from an end periphery of the address-electrode dielectric layer 122.

The address-electrode dielectric layer 122 is formed exemplarily of glass paste to protect the address electrode 121. The address-electrode dielectric layer 122 is provided on the inner side of the rear substrate 120 to cover the address electrode 1.

The partition layer 123 is formed exemplarily of the glass paste containing the same components as the glass paste forming the address-electrode dielectric layer 122 and provided on a surface facing the front substrate 110. As shown in FIGS. 1 and 2, the partition layer 123 includes a plurality of zonal partition portions 124. The zonal partition portions 124 longitudinally extend substantially along a height direction (second direction) of the PDP 100. The zonal partition portions 124 are spaced apart from one another by a predetermined distance and aligned substantially along a width direction (first direction) that is perpendicular to the height direction.

The zonal partition portion 124 includes: a plurality of first partitions 125 provided substantially along the width direction; and a pair of second partitions 126 provided substantially along the height direction. A recessed portion 124A is defined by the first partitions 125 and the second partitions 126.

A width dimension J of the first partition 125 is smaller than an inner-diameter dimension D of a nozzle opening 201 of a nozzle 200 used for forming a phosphor layer 128.

The recessed portion 124A, whose column width C and transversal width I are set to have desired values (i.e., values corresponding to the discharge cell in the PDP 100), is located on the address electrode 121.

At a position facing the non-display area 100B of the PDP 100 on an end side of the first partition 125 in the longitudinal direction, a guide partition 127 is provided.

The guide partition 127 longitudinally extends substantially along a center line F between a pair of first partitions 125 at a position spaced apart from the nearest second partition 126 by a distance H. A longitudinal length dimension B of the guide partition 127 is smaller than a transverse width I of the recessed portion 124A.

When the length dimension B of the guide partition 127 is larger than the transverse width I of the recessed portion 124A, the distance H may not be sufficiently secured depending on, for instance, positions where the second partition 126 and the guide partition 124 are provided. When the distance H is not sufficiently secured as stated above, the nozzle 200 cannot be sufficiently accelerated when the nozzle 200 is moved in the later-described phosphor layer forming step. Consequently, the moving speed of the nozzle 200 in applying a phosphor paste to the recessed portion 124A may not be set at a predetermined speed.

On the other hand, when the length dimension B of the guide partition 127 is smaller than the transverse width I of the recessed portion 124A, the distance H can be sufficiently secured. Thus, the nozzle 200 can be sufficiently accelerated when being moved, whereby the moving speed of the nozzle 200 in applying the phosphor paste to the recessed portion 124A can be set at the predetermined speed.

A width dimension A of the guide partition 127 is smaller than the width dimension J of the first partition 125.

When the width dimension A of the guide partition 127 is larger than the width dimension J of the first partition 125, a difference between the width dimension A and the column width C is reduced, such that the phosphor paste ejected by the nozzle 200 may be applied on a top of the first partition 125. Specifically, when the phosphor paste contacts the guide partition 127, the phosphor paste spreads in the width direction of the guide partition 127 due to the contact, and a width dimension K of the phosphor paste applied at an application position E is increased. With the width dimension K increased, a gap between the first partition 125 and the phosphor paste applied at the application position E is decreased, whereby the phosphor paste may be applied on the top of the first partition 125 due to an influence of static electricity and the like.

On the other hand, when the width dimension A of the guide partition 127 is smaller than the width dimension J of the first partition 125, the difference between the width dimension A and the column width C can be sufficiently secured, thereby preventing the phosphor paste from being applied on the top of the first partition 125. Specifically, since the spread of the phosphor paste when the phosphor paste contacts the guide partition 127 can be reduced, the width dimension K can be suppressed to a minimum value even if the phosphor paste spreads in all over the width direction of the guide partition 127. By suppressing the width dimension K to the minimum value, the gap between the first partition 125 and the phosphor paste applied at the application position E is sufficiently secured, thereby preventing the phosphor paste from being applied on the top of the first partition 125 due to the influence of the static electricity and the like.

As shown in FIG. 1, the phosphor layer 128 is continuously provided between the neighboring first partitions 125 to longitudinally extend along the longitudinal direction of the first partition 125 (the width dimension of the PDP 100).

Specifically, the phosphor layer 128 includes a red phosphor layer 128R, a green phosphor layer 128G and a blue phosphor layer 128B. As shown in FIG. 1, the phosphor layers 128R, 128G, 128B are allayed respectively in plurality in the longitudinal direction of the second partition 126 in the order of the red phosphor layer 128R, the green phosphor layer 128G and the blue phosphor layer 128B. The phosphor layers 127R, 127G, 127B are continuously provided along a line between the first partitions 126.

[Manufacturing Method of PDP]

Next, a manufacturing method of the PDP 100 according to the first embodiment will be described.

Figure 3:
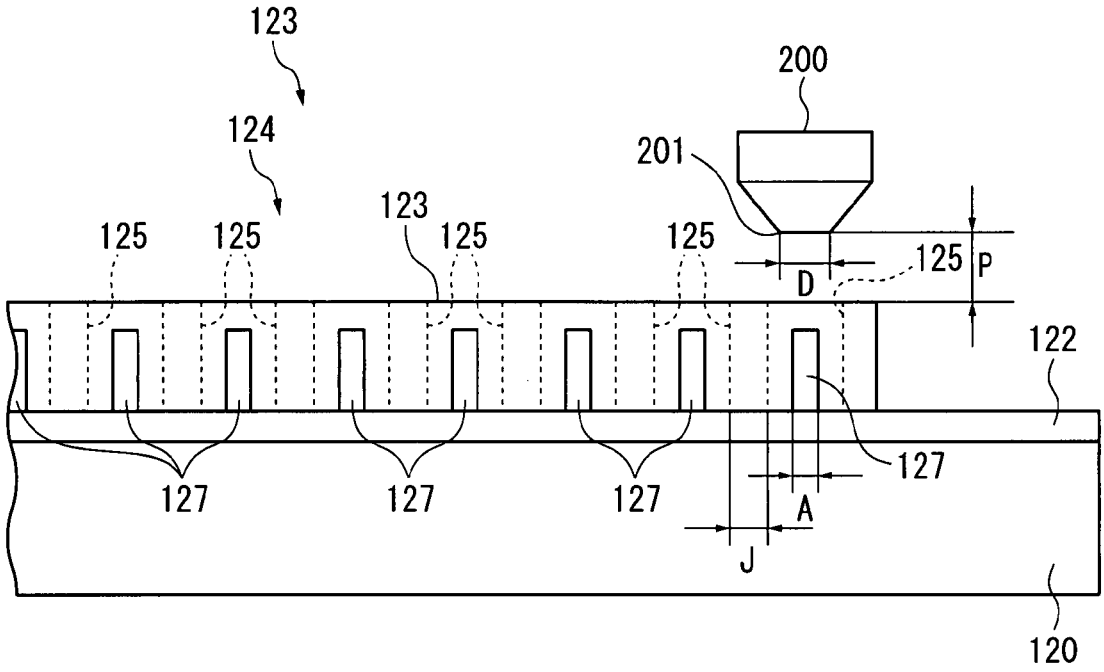
FIG. 3 is a side view schematically showing a nozzle for ejecting a phosphor paste and the rear substrate during a phosphor layer forming step according to the first embodiment.

FIG. 3 is a side view schematically showing the nozzle for injecting the phosphor paste and the rear substrate during the phosphor layer forming step.

The manufacturing method of the PDP 100 according to the first embodiment includes: a front substrate manufacturing step for manufacturing the front substrate 110; a rear substrate manufacturing step for manufacturing the rear substrate 120; and a superposing step for superposing the front substrate 110 and the rear substrate 120 to manufacture the PDP 100.

In the front substrate manufacturing step, a transparent-electrode-forming material layer is provided on the entirety of the inner side of the front substrate 110, and the transparent electrodes 111A, 111B are formed. Then, linear patterns formed of Ag material are laminated on ends of the transparent electrodes 111A, 111B, and the bus electrodes are formed by calcination of the patterns. Subsequently, a paste pattern of a black inorganic pigment is exemplarily applied between the bus electrodes, whereby the plurality of black stripes 112 are formed by calcination of the paste pattern. Then, a dielectric paste is applied to the front substrate 110 in laminae, whereby the dielectric layer 113 is formed by calcination of the dielectric paste. The protective layer 114 is film-formed on the dielectric layer 113 by vapor deposition, sputtering or the like.

Next, the rear substrate manufacturing step is performed. The rear substrate manufacturing step includes an address electrode forming step, a dielectric layer forming step, a partition forming step and the phosphor layer forming step.

In the address electrode forming step, the address electrode 121 is formed on the rear substrate 120. In the dielectric layer forming step, the address-electrode dielectric layer 122 is formed to cover the address electrode 121.

In the partition forming step, a partition-forming material layer is uniformly applied to the address-electrode dielectric layer 122. Then, a film molding die is exemplarily disposed on the partition-forming material layer, and the partition layer 123 is formed by plastic-deforming the partition-forming material layer using a transfer roller. The molding die has convexes and concaves of predetermined dimensions that correspond to the first partition 125, the second partition 126, the guide partition 127 and the recessed portion 124A. By plastic-deforming the partition-forming material layer by the transfer roller, the partition layer 123 is provided, the partition layer 123 including: the recessed portion 124A with the column width C and the transverse width I; the first partition 125 extending in the width direction; the second partition 126 extending in the column direction; and the guide partition 127 formed on the end of the first partition 123, as described above.

In the phosphor layer forming step, the phosphor layer 128 is formed by applying the phosphor paste. In applying the phosphor paste, a nozzle 200 adapted to inject the phosphor paste is used as shown in FIG. 3. The nozzle 200 is adapted to be moved by a scanning mechanism (not shown) in the longitudinal direction of the first partition 125, i.e., the width direction of the PDP 100.

As shown in FIGS. 2 and 3, above the vicinity of a first end of the guide partition 127 (the first end being opposite to a second end that faces the second partition 126), the nozzle 200 is located at such a position as follows when the application is started: the position where an application gap P between the nozzle 200 and the top of the guide partition 127 is 1.5 times or less of the inner-diameter dimension D of the nozzle opening 201 and where the center of the nozzle opening 201 substantially coincides with the center line F.

When the application gap P is more than 1.5 times of the inner-diameter dimension D, a thickness of the phosphor layer 128 actually formed may widely vary relative to a target thickness of the phosphor layer 128. Thus, the nozzle 200 is located at the position where the application gap P is 1.5 times or less of the inner-diameter dimension D.

Then, the nozzle 20 is moved in the width direction at a constant speed while injecting the phosphor paste at a constant predetermined injection amount.

The phosphor paste, injected from the nozzle 200, contacts the guide partition 127 which is located closer to the nozzle 200 than the address-electrode dielectric layer 122. The phosphor paste injected from the nozzle 200 has a characteristic where the application position E of the phosphor paste is stabilized once the phosphor paste bridges between the nozzle 200 and the rear substrate 120. Thus, the center of the application position E is determined at a position where the center of the application position E substantially coincides with the center of the guide partition 127 (i.e., a position where the center of the application position E substantially coincides with the center line F). When the nozzle 200 is moved, the nozzle 200 applies the phosphor paste while maintaining the center of the application E to substantially coincide with the center line F.

Subsequently, when the nozzle 200 is moved to a second portion of the non-display area 100B that is opposite to a first portion of the non-display area 100B (in the first portion, the guide partition 127 is provided), the nozzle 200 stops injecting the phosphor paste.

The above-described operation is performed to apply the phosphor paste substantially all over the rear substrate 120 such that the red phosphor paste, the green phosphor paste and the blue phosphor paste are arranged along the longitudinal direction of the second partition 126 in this order. Although one nozzle 200 is shown in FIG. 3, a plurality of nozzles 200 are simultaneously moved along the first partition 125 in the actual operation, such that the phosphor pastes of plural colors are simultaneously applied.

Thereafter, a heat-treating step for heat-treating the applied phosphor paste is performed, such that the phosphor layer 128 is formed by calcination. At this time, since the nozzle 200 is moved after the phosphor paste is brought into contact with the guide partition 127, an end of the phosphor layer 128 is formed on the guide partition 127.

Subsequently, by performing the superposing step, the front substrate 110 and the rear substrate 120 are superposed, thereby manufacturing the PDP 100.

EXAMPLES

Examples to test effects of the first embodiment will be described below.

Figure 4:
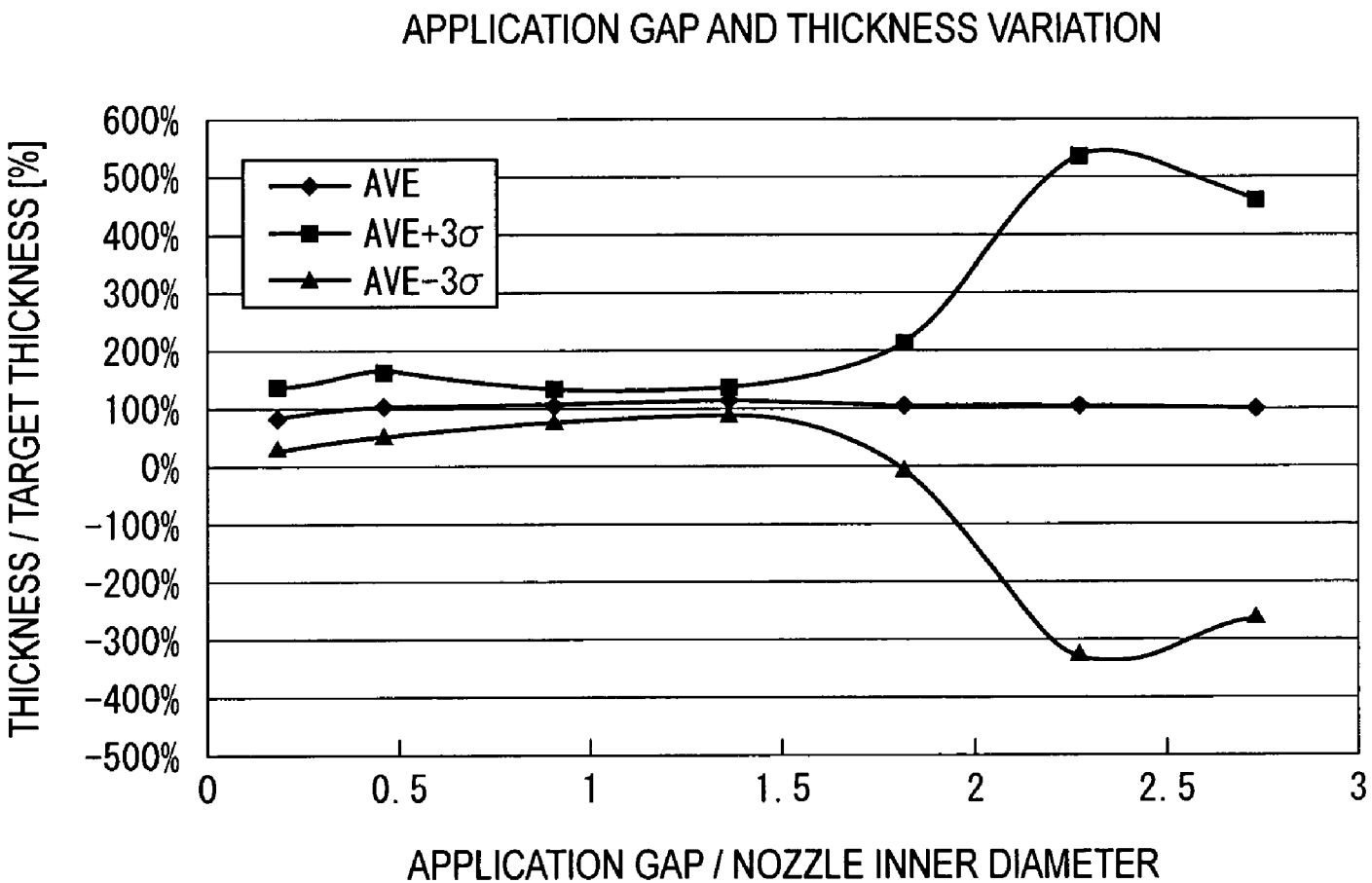
FIG. 4 is a graph showing a relationship between an application gap and a thickness variation in an example according to the present invention.

FIG. 4 is a graph showing a relationship between the application gap and the thickness variation.

Initially, the rear substrate 120 shown in, for example, FIGS. 2 and 3 was prepared, on which the zonal partition portion 124 and the guide partition 127 were provided.

At the time of starting the application, the nozzle 200 was initially positioned at the position where the center of the nozzle opening 201 substantially coincided with the center line F above the vicinity of the first end of the guide partition 127 that was opposite to the second end facing the second partition 126. The nozzle 200 was further positioned at a position where a value obtained by dividing the application gap P between the nozzle 200 and the guide partition 127 by the inner-diameter dimension D was approximately 0.2.

Then, the nozzle 200 was moved from the position in the width direction at such a constant speed as to conform the thickness of the phosphor layer 128 to the target thickness while injecting the phosphor paste at a constant predetermined injection amount, thereby applying the phosphor paste. Subsequently, the applied phosphor paste was heat-treated to calcinate the phosphor layer 128. Thereafter, using a plurality of samples prepared under the same conditions, there were calculated an average of values obtained by dividing the thickness of the phosphor layer 128 of the sample by the target thickness (hereinafter, referred to as "thickness ratio average value") and a variation thereof (hereinafter, referred to as "thickness ratio variation").

By performing the above-described processes, the phosphor layers 128 were formed by starting the application of the phosphor paste from respective positions where each of the values obtained by dividing the application gap P by the inner-diameter dimension D was approximately 0.5, 1.0, 1.3, 1.8, 2.3 and 2.7, whereby the sample including the phosphor layers formed as above were prepared. The sample was prepared in plurality per each condition. Then, the thickness ratio average value and the thickness ratio variation of the phosphor layers 128 were calculated.

As shown in FIG. 4, it was observed that the thickness ratio average ("AVE" in FIG. 4) was approximately 100 percent irrespective of a difference in the application gap P. In short, the average thickness of the phosphor layer 128 was observed to be substantially equal to the target thickness irrespective of the difference in the application gap P.

When the value obtained by dividing the application gap P by the inner-diameter dimension D was less than 1.5, the thickness ratio variation ("AVE+3σ" and "AVE−3σ" in FIG. 4) was in either range of 100 to 200 percent (100 percent or more and less than 200 percent) or of 0 to 100 percent (0 percent or more and less than 100 percent). In other words, the variation relative to the target thickness was observed to be small.

When the value obtained by dividing the application gap P by the inner-diameter dimension D was more than 1.5, the thickness ratio variation became 200 percent or more or 0 percent or less. In other words, the variation relative to the target thickness was observed to be large.

Accordingly, it was observed that, when the value obtained by dividing the application gap P by the inner-diameter dimension D was less than 1.5, the phosphor layer 128 could be formed with the small variation relative to the target thickness.

Effects and Advantages of First Embodiment

According to the above-described arrangement according to the first embodiment, the following effects and advantages are expected.

(1) In the PDP 100 according to the first embodiment, the guide partition 127 extends substantially along the center line F between the pair of first partitions 125 at the position spaced apart from the nearest second partition 125 by the distance H. The end of the phosphor layer 128 is formed on the guide partition 127.

With this arrangement, the phosphor paste injected from the nozzle 200 when the application is stared in the phosphor forming step contacts the guide partition located closer to the nozzle 200 than the address-electrode dielectric layer 122, whereby the end of the phosphor layer 128 can be formed on the guide partition 127. Accordingly, the phosphor paste can bridge between the nozzle 200 and the rear substrate 120 quickly as compared with a conventional arrangement in which the application is started after the phosphor paste directly contacts the rear substrate 120. Hence, the phosphor paste can bridge between the nozzle 200 and the rear substrate 120 quickly without performing such a complex control as to approximate the nozzle 200 to the rear substrate 120 when the application is started or to increase the injection amount only when the application is started.

By utilizing the characteristic where the application position E of the phosphor paste is stabilized once the phosphor paste bridges between the nozzle 200 and the rear substrate 120, the center of the application position E can be positioned at the position where the center of the application position E substantially coincides with the center line F. The nozzle 200 can apply the phosphor paste while maintaining the center of the application position E to substantially coincide with the center line F during the moving operation. Accordingly, without correcting a position of the nozzle 200 in a right-and-left direction relative to the moving direction of the nozzle 200, the center of the application position E can substantially coincide with the center line F. Specifically, even when the application is started while the center of the nozzle opening 201 is misaligned from the center line F by 50 μm above the guide partition 127, the center of the application position E can substantially coincide with the center line F.

Thus, accuracy in applying the phosphor paste can be easily enhanced.

(2) The longitudinal length dimension B of the guide partition 127 is smaller than the transverse width I of the recessed portion 124A.

With this arrangement, the distance H can be sufficiently secured, whereby the nozzle 200 can be sufficiently accelerated during the moving operation in the phosphor layer forming step. Thus, the moving speed of the nozzle 200 when applying the phosphor paste to the recessed portion 124A can be set at a predetermined constant speed, thereby forming a stable phosphor layer 128.

(3) The width dimension A of the guide partition 127 is smaller than the width dimension J of the first partition 125.

With this arrangement, the difference between the width dimension A and the column width C can be sufficiently secured, thereby preventing the phosphor paste from being applied on the top of the first partition 125. Specifically, since the spread of the phosphor paste when the phosphor paste contacts the guide partition 127 can be reduced, the width dimension K can be suppressed to a minimum value even if the phosphor paste spreads in all over the width direction of the guide partition 127. With this arrangement, the difference between the application position E and the first partition 125 can be sufficiently secured, thereby preventing the phosphor paste from being applied on the top of the first partition 125 due to an influence of static electricity. Thus, a further stable phosphor layer 128 can be provided.

(4) In the phosphor forming step, the nozzle 200 having been located above the guide partition 127 initially applies the phosphor paste to the guide partition 127. Then, the nozzle 200 injects the phosphor paste while being moved substantially along the center line F, thereby providing the phosphor layer whose end is formed on the guide partition 127.

Thus, without performing a complex control, the phosphor paste can bridge between the nozzle 200 and the rear substrate 120 quickly as compared with a conventional arrangement in which the application is started after the phosphor paste is directly applied on the rear substrate 210. In addition, without correcting the position of the nozzle 200 in the right-and-left direction relative to the moving direction of the nozzle 200, the center of the application position E can substantially coincide with the center line F. Thus, accuracy in applying the phosphor paste can be easily enhanced.

(5) In the phosphor forming step, the red phosphor paste, the green phosphor paste and the blue phosphor paste are applied to the lines between the first partitions 125 such that the red phosphor layer 128R, the green phosphor layer 128G and the blue phosphor layer 128B are arrayed in this order along the longitudinal direction of the second partition 126. As described above, since the phosphor paste is applied along the line between the first partitions 125, the phosphor paste does not flow into the other neighboring lines.

Accordingly, for example, the red phosphor paste, green phosphor paste and blue phosphor paste can be simultaneously applied along the lines neighboring one another, thereby improving an operation efficiency in the phosphor layer forming step.

As described above, since the phosphor paste can bridge between the nozzle 200 and the rear substrate 120 quickly as compared with a conventional arrangement, it is possible to prevent the phosphor pastes applied in the neighboring lines from contacting each other due to an attraction force working between the phosphor pastes applied in the neighboring lines. Thus, a stable red, green and blue phosphor layers 128R, 128G, 128B can be formed.

(6) In the phosphor layer forming step, the nozzle 200 is located at the position where the application gap P is 1.5 times or less of the inner-diameter dimension D of the nozzle opening 201 and the application is started.

With this arrangement, the thickness ratio variation of the phosphor layer 128 can be reduced as compared with an arrangement in which the application is started from a position where the application gap P is 1.5 times or more of the inner-diameter dimension D. Thus, a further stable phosphor layer 128 can be provided.

Second Embodiment

A second embodiment of the present invention will be described below with reference to the attached drawings.

The PDP according to the second embodiment is arranged identically to that of the first embodiment except for the rear substrate. Thus, the description of the PDP arrangement below will be directed only to the arrangement of the rear plate. The same components as in the first embodiment will be referred to with the same numerals and names, a detailed explanation for which will be omitted as necessary.

[Arrangement of PDP]

Figure 5:
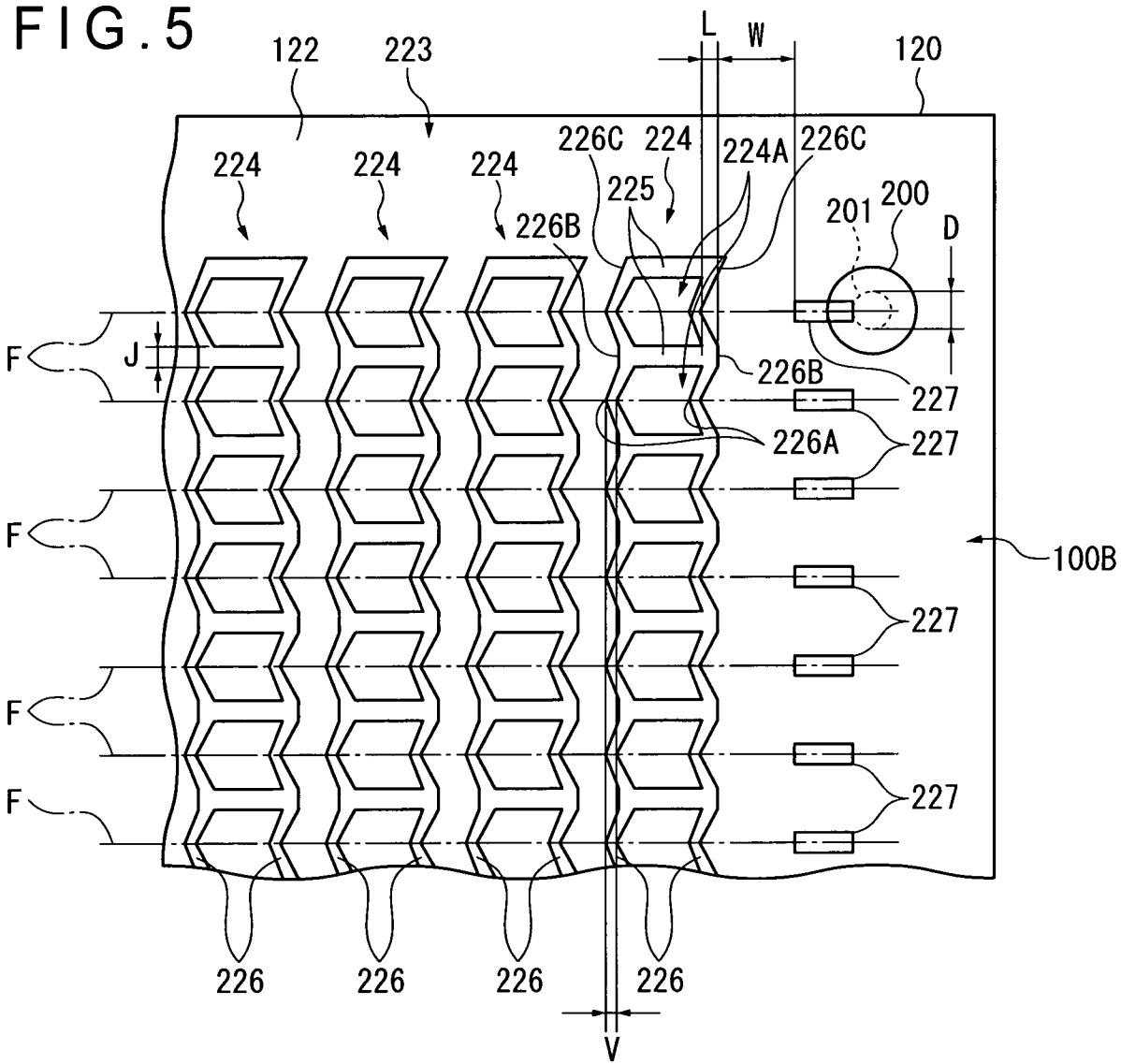
FIG. 5 is a plan view showing a vicinity of an end of a rear substrate according to the second embodiment.

FIG. 5 is a plan view showing the vicinity of the end of the rear substrate according to the second embodiment.

In FIG. 5, the rear substrate of the PDP, referred to with the numeral 120, includes the address electrode (not shown), the address-electrode dielectric layer 122, a partition layer 223 and the like.

The partition layer 223 includes a plurality of zonal partition portions 224. The zonal partition portions 224 longitudinally extend substantially along the height direction (second direction) of the PDP. The zonal partition portions 224 are spaced apart from one another by a predetermined distance and are aligned substantially along the width direction (first direction) perpendicular to the height direction.

The zonal partition portion 224 includes: a plurality of first partitions 225 provided substantially along the width direction; and a pair of second partitions 226 provided substantially along the height direction. A recessed portion 224A is defined by the first partitions 225 and the second partitions 226.

The second partition 226 includes a bent portion 226A provided at a portion corresponding to substantially the center between the neighboring pair of first partitions 225, the bent portion 226A being bent to protrude in the width direction of the PDP. Specifically, the bent portion 226A is bent to protrude in the moving direction of the nozzle 200 in the phosphor paste applying operation, and is provided to be positioned on the center line F between the pair of first partitions 225. Width dimensions L of a connector 226B with which the second partition 226 is connected with the first partition 225, a first end 226C in the longitudinal direction of the second partition 226 and a second end (not shown) are larger than a width dimension V of the bent portion 226A and smaller than the width dimension J of the first partition 225. Although the width dimension V of the bent portion 226A may be limited by characteristics of the PDP, the width dimension V is preferably a half or less of the inner-diameter dimension D.

At a position facing the non-display area 100B on an end side of the first partition 225 in the longitudinal direction, a guide partition 227 is provided.

The guide partition 227 longitudinally extends substantially along the center line F at a position spaced apart from the nearest second partition 226 by a distance W.

[Manufacturing Method of PDP]

Next, a manufacturing method of the PDP 100 according to the second embodiment will be described below.

Since the front substrate forming step and the superposing step are the same as in the first embodiment, the explanation will be directed only to a rear substrate forming step.

The partition forming step in the rear substrate forming step is performed after the address electrode 121 is formed on the rear substrate 120 in the address electrode forming step and the address-electrode dielectric layer 122 is formed in the dielectric layer forming step.

In the partition forming step, the same processes as in the first embodiment are performed to provide the partition layer 223 including the recessed portion 224A, the first partition 225, the second partition 226 and the guide partition 227.

In the phosphor layer forming step, the phosphor layer (not shown) is formed by applying the phosphor paste.

As shown in FIG. 5, above the vicinity of a first end of the guide partition 227 (the first end being opposite to a second end that faces the second partition 226), the nozzle 200 is located at such a position as follows when the application is started: the position where the application gap P between the nozzle 200 and a top of the guide partition 227 is 1.5 times or less of the inner-diameter dimension D of the nozzle opening 201 and where the center of the nozzle opening 201 substantially coincides with the center line F.

Then, the nozzle 20 is moved in the width direction at a constant speed while injecting the phosphor paste at a constant predetermined injection amount.

At this time, the phosphor paste injected by the nozzle 200 contacts the guide partition 227. Due to the above-described effects, the phosphor paste is applied while maintaining the center of the application position to substantially coincide with the center line F when the nozzle 200 is moved.

When the nozzle 200 is moved across the second partition 226, the phosphor paste contacts the bent portion 226A protruding from the second partition 226 until the last moment. Accordingly, even when the center of the application position of the phosphor paste is more or less misaligned with the center line F immediately before crossing the second partition 226, the phosphor paste contacts the bent portion 226A located on the center line F until the last moment, whereby the center of the application position is corrected to substantially coincide with the center line F after crossing the second partition 226.

Incidentally, in applying the phosphor paste, a plurality of nozzles 200 are simultaneously moved along the first partition 225, such that the phosphor pastes of plural colors are simultaneously applied.

Effects and Advantages of Second Embodiment

According to the above-described arrangement according to the second embodiment, the following effects and advantages are expected in addition to the effects and advantages (1), (4) to (6) obtained in the first embodiment.

(7) The second partition 226 includes a bent portion 226A provided at the portion corresponding to substantially the center between the neighboring pair of first partitions 225, the bent portion 226A being bent to protrude in the moving direction of the nozzle 200 in the phosphor layer applying operation.

With this arrangement, when the nozzle 200 is moved across the second partition 226 in the phosphor paste applying operation, the phosphor paste can contact the bent portion 226A protruding from the second partition 226 until the last moment. Accordingly, even when the center of the application position of the phosphor paste is more or less misaligned with the center line F immediately before crossing the second partition 226, the phosphor paste contacts the bent portion 226A located on the center line F until the last moment, whereby the center of the application position can be corrected to be substantially coincide with the center line F after crossing the second partition 226. Thus, accuracy in applying the phosphor paste can be further enhanced.

Third Embodiment

A third embodiment of the present invention will be described below with reference to the attached drawings.

The PDP according to the third embodiment is arranged identically to that of the first embodiment except for the rear substrate. Thus, the description of the PDP arrangement below will be directed only to the arrangement of the rear plate. The same components as in the first embodiment will be referred to with the same numerals and names, a detailed explanation for which will be omitted as necessary.

[Arrangement of PDP]

Figure 6:
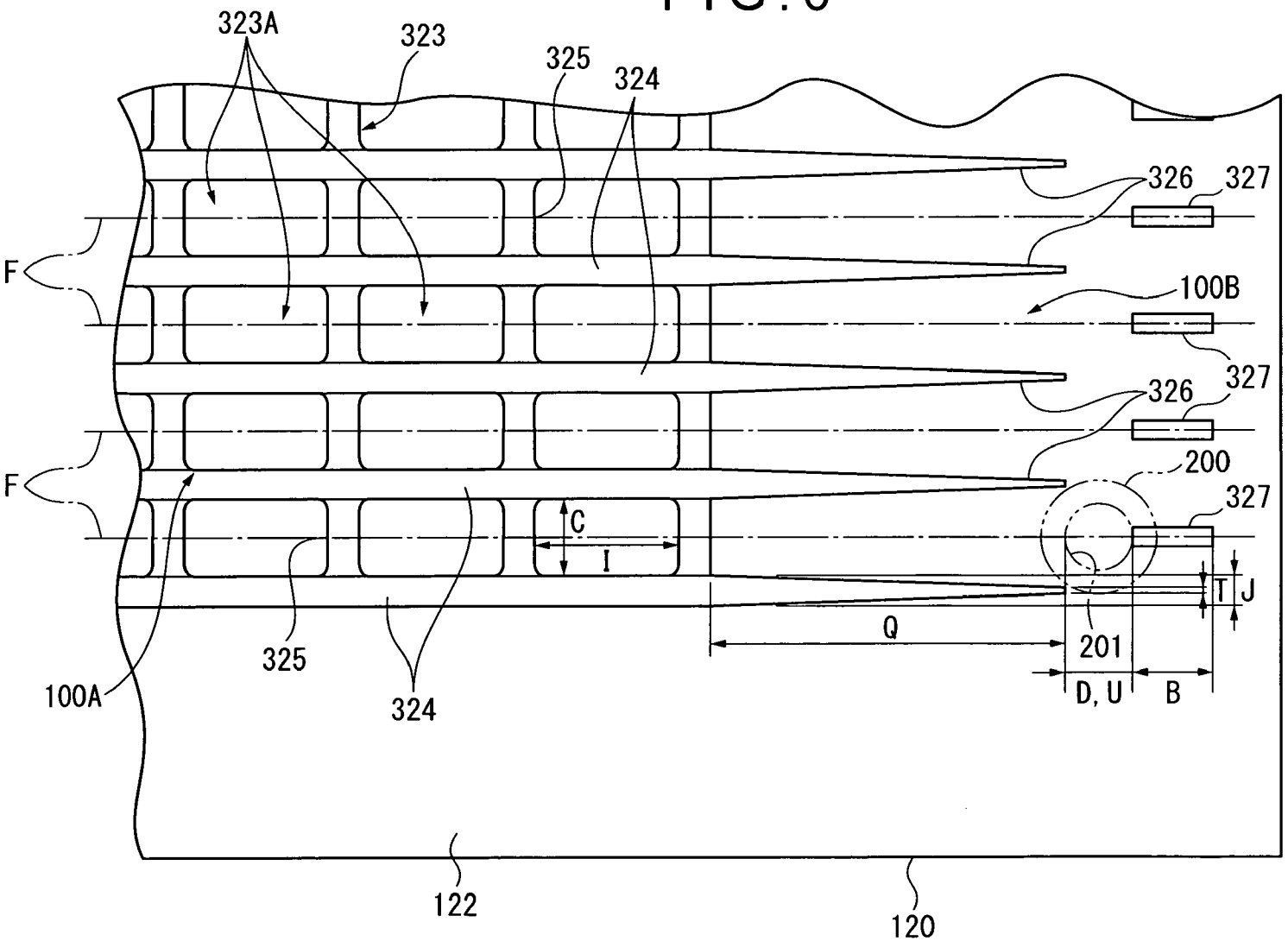
FIG. 6 is a plan view showing a vicinity of an end of a rear substrate according to a third embodiment.
Figure 7:
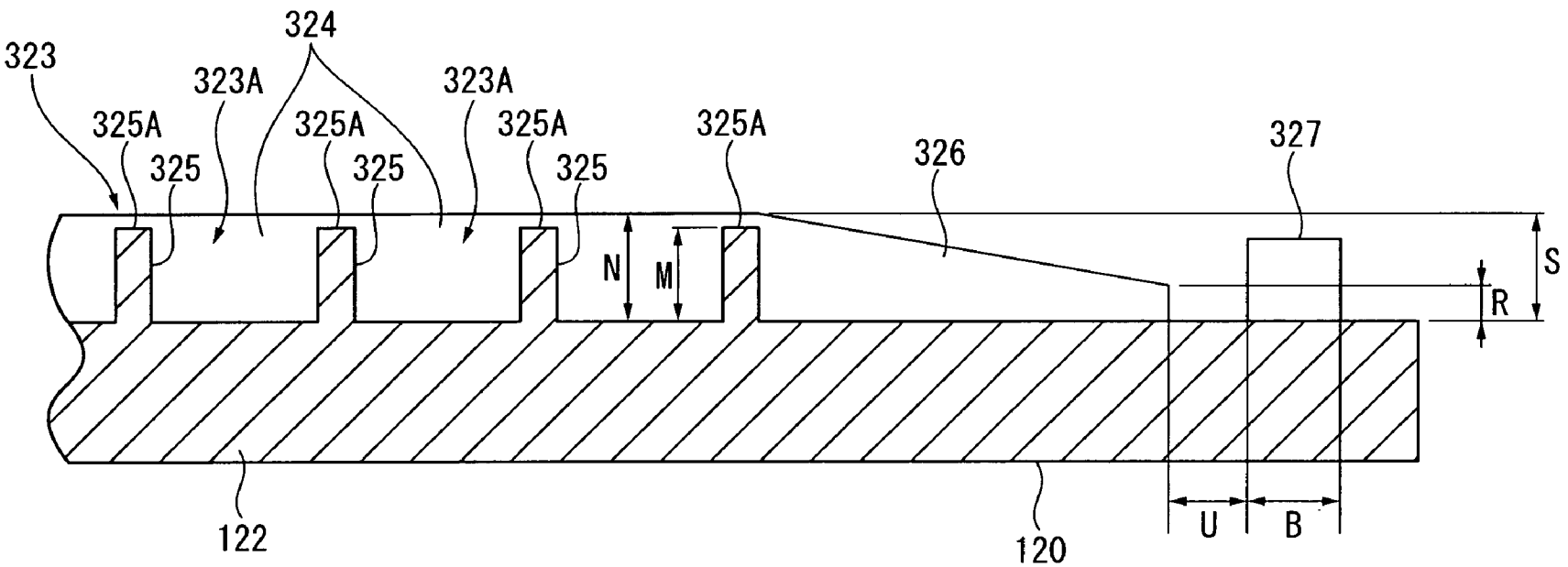
FIG. 7 is a cross-sectional view showing the vicinity of the end of the rear substrate according to the third embodiment.
Figure 8:
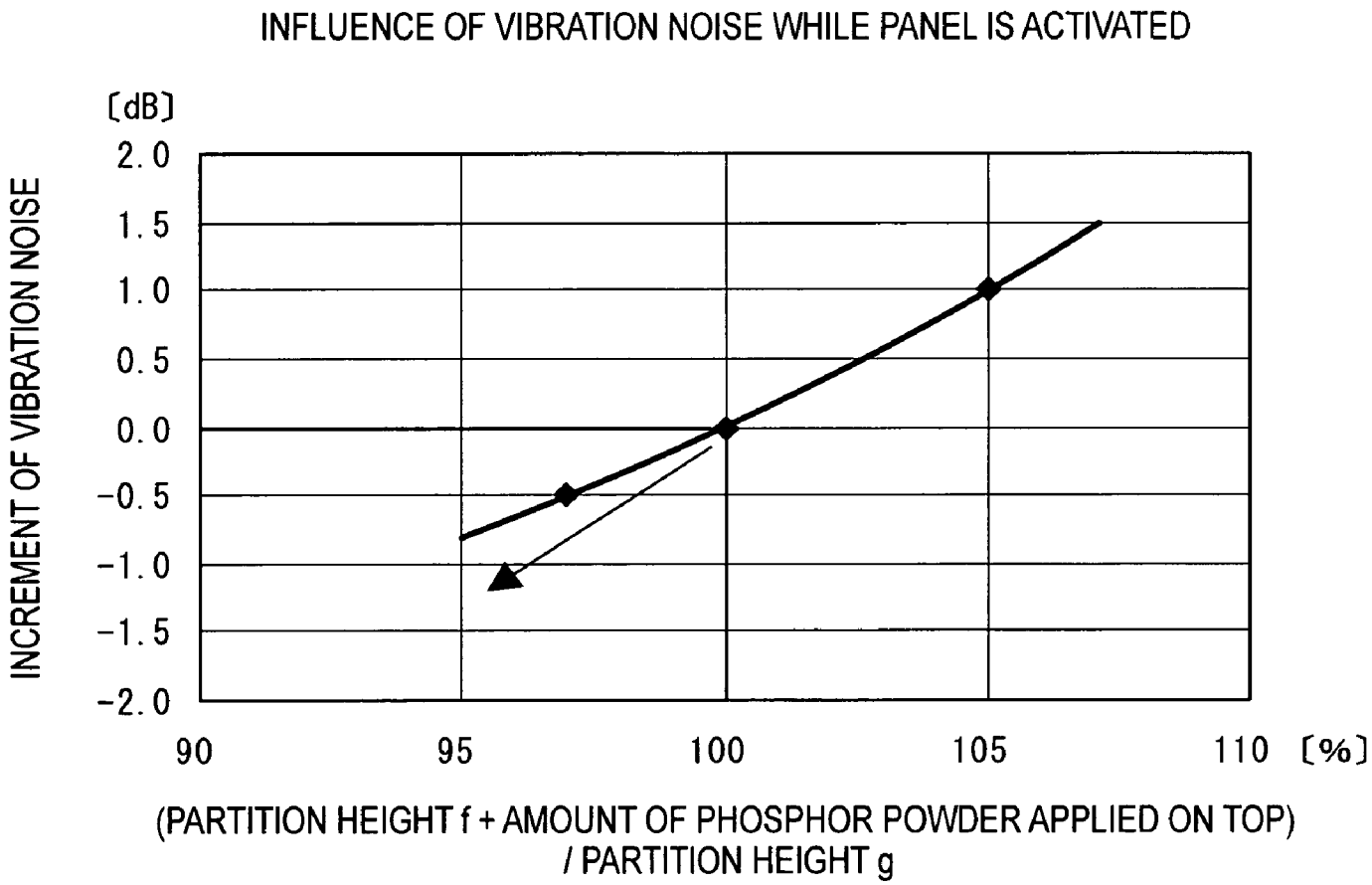
FIG. 8 is a graph showing an influence of a vibration noise while the panel is activated according to the third embodiment.
Figure 9:
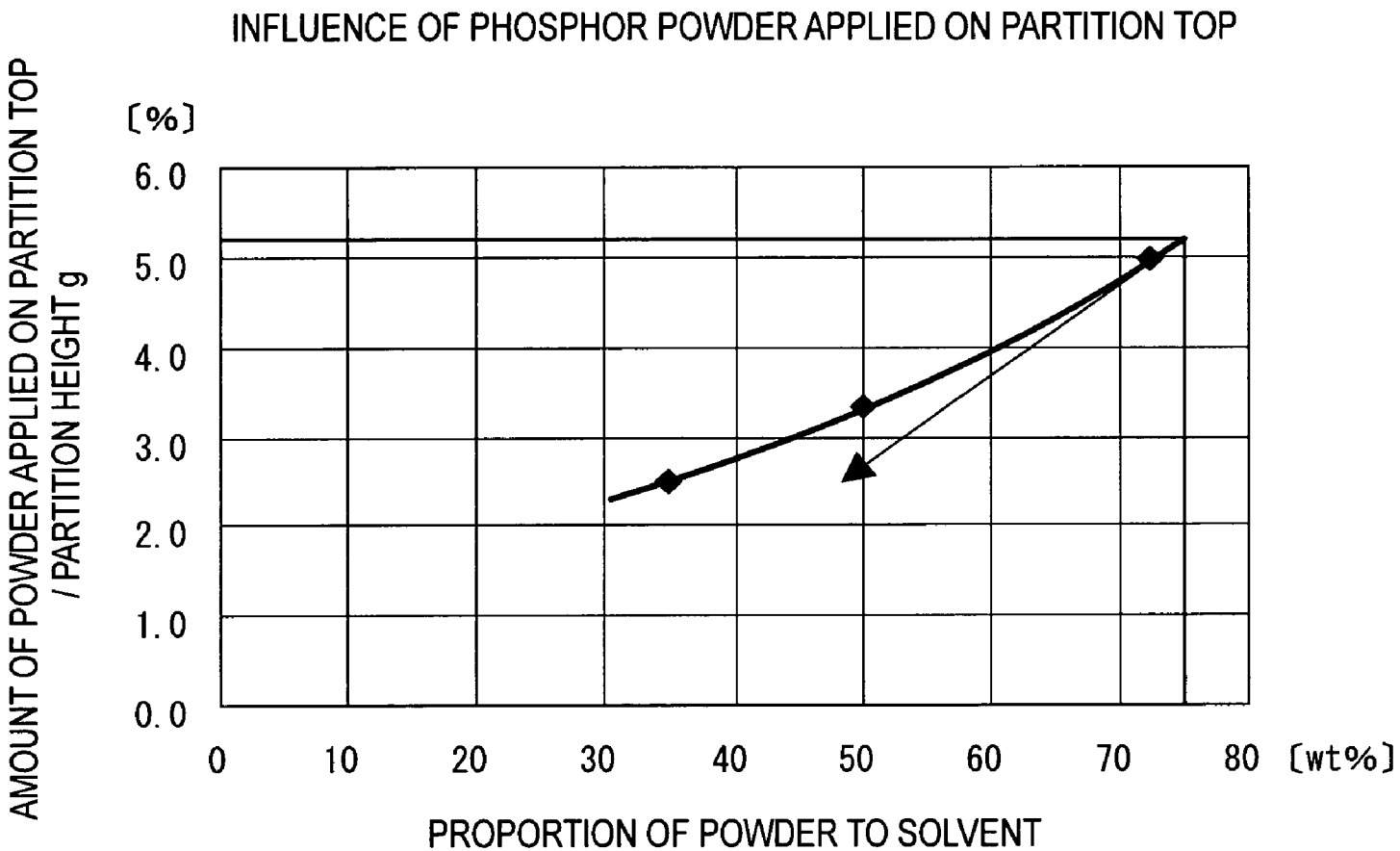
FIG. 9 is a graph showing an influence of phosphor powder applied on a top side of a partition according to the third embodiment.

FIG. 6 is a plan view showing a vicinity of an end of a rear substrate according to the third embodiment. FIG. 7 is a cross-sectional view showing the vicinity of the end of the rear substrate according to the third embodiment. FIG. 8 is a graph showing an influence of a vibration noise while the panel is activated. FIG. 9 is a graph showing an influence of phosphor powder applied on a top side.

In FIGS. 6 and 7, the rear substrate of the PDP, referred to with the numeral 120, includes the address electrode (not shown), the address-electrode dielectric layer 122, a partition layer 323 and the like.

The partition layer 323 includes: a first partition 324 provided substantially along the width direction (a first direction) of the PDP; and a second partition 325 provided substantially along the height direction (a second direction) perpendicular to the width direction. A recessed portion 323A is defined by the first partitions 324 and the second partitions 325.

The recessed portion 323A, whose column width C and transversal width I are set to have desired values (i.e., values corresponding to the discharge cell in the PDP), is located on the address electrode 121.

In addition, as shown in FIG. 7, the second partition 325 bridging between the first partitions 324 is partially provided with a low wall portion 325A whose height dimension M from the surface of the address-electrode dielectric layer 122 is set to be smaller than a height dimension N of the first partition 324 from the surface of the address-electrode dielectric layer 122. The low wall portion 325A may be provided to a part of the portion between the first partitions 324 or may be provided to the entirety of the portion between the first partitions 324.

At a position facing the non-display area 100B on an end side of the first partition 324 is provided an extension 326.

The extension 326 longitudinally extends substantially along the width direction of the PDP on an extension of the first partition 324. A longitudinal length dimension Q of the extension 326 is larger than the transversal width I of the recessed portion 323A. When the longitudinal length dimension Q of the extension 326 is smaller than the transversal width I of the recessed portion 323A, a stability of a phosphor paste applied in the phosphor layer forming step for forming the phosphor layer (not shown) may be reduced. On the other hand, by setting the length dimension Q of the extension 326 to be larger than the transversal width I of the recessed portion 323A, the phosphor paste can be stably applied to the recessed portion 323A.

The extension 326 is formed to reduce a height dimension from the address-electrode dielectric layer 122 toward an out-of-plane direction from an in-plane direction of the rear substrate 120.

Specifically, a height dimension R of an out-of-plane directional end of the extension 326 is preferably set to be 94.8 percent or less of a height dimension S of an in-plane directional end thereof.

When the height dimension R of the out-of-plane directional end of the extension 326 is set to be more than 94.8 percent of the height dimension S (the height dimension of the first partition) of the in-plane directional end, the phosphor paste may be applied on the top side of the extension 326 in the later-described the phosphor layer forming step, such that phosphor powder is placed on the top side of the extension 326 by calcinations. In that case, the height dimension of the extension 326 may become higher than the height dimension S of the in-plane directional end of the extension 326. In that case, as shown in FIG. 8, in the display area 100A of the PDP 100 may be formed a gap corresponding to the height of the phosphor paste applied on the top side of the extension 326, whereby a resonance may be caused to generate a noise.

In contrast, when the height dimension R of the out-of-plane directional end of the extension 326 is 94.8 percent or less of the height dimension S of the in-plane directional end, a gap is formed between the front substrate 110 and the extension 326 even if the phosphor paste is applied on the top side of the extension 326, whereby no gap is formed in the display area 100A of the PDP 100. Particularly, the phosphor paste for forming the phosphor layer 326 is generally formed such that a proportion of the phosphor powder to a solvent is 75 percent or less. Even when the phosphor paste whose phosphor powder proportion is 75 percent is applied on the top side of the extension 326, as shown in FIG. 9, the height dimension of the extension 326 does not become larger than the height dimension S of the first partition 324 as long as the height dimension R of the out-of-plane direction end of the extension 326 is 94.8 percent or less of the height dimension S of the in-place directional end. Accordingly, a stable phosphor layer can be formed.

The extension 326 is formed to reduce a dimension of a width that is substantially perpendicular to the width direction of the PDP toward the out-of-plane direction from the in-plane direction.

Specifically, a width dimension T of the out-of-plane directional end of the extension 326 is preferably set to be 90 percent or less of a width dimension J (the width dimension of the first partition) of the in-plane directional end.

When the width dimension T of the out-of-plane directional end of the extension 326 is set to be more than 90 percent of the width dimension J of the in-plane directional end, the phosphor paste may be applied on the top side of the extension 326. Specifically, in the phosphor layer forming step, the phosphor paste is injected by the nozzle so as to be applied. The nozzle is moved along the longitudinal direction of the first partition 324 from a first end of the first partition 324 to a second end of the first partition 324 at a constant speed. Since the speed of the nozzle is decreased when the application of the phosphor paste is started and terminated, the phosphor paste may be injected in an amount more than a predetermined amount at such times. Thus, the phosphor paste may be applied on the top side of the extension 326. When the phosphor paste is applied on the top side of the extension 326 in the amount more than the predetermined amount, the gap may be formed in the display area 100A of the PDP, whereby a noise may be generated due to the resonance, as described above.

On the other hand, when the width dimension T of the out-of-plane directional end of the extension 326 is set to be 90 percent or less of the width dimension J of the in-plane directional end, the phosphor paste does not protrude onto the top side of the extension 326, whereby the stable phosphor layer can be formed.

At a position facing the non-display area 100B of the PDP 100 on an end side of the first partition 324 is provided a guide partition 327.

The guide partition 327 longitudinally extends substantially along the center line F between the pair of first partitions 324 at a position spaced apart from the nearest second partition 326 by a distance U. The longitudinal length dimension B of the guide partition 327 is smaller than the transverse width I of the recessed portion 324A, as in the guide partition 127 according to the first embodiment. The distance U is equal to the inner-diameter dimension D of the nozzle opening 201. Incidentally, the distance U may be determined as desired as long as the distance U is equal to or less than the inner-diameter dimension D.

[Manufacturing Method of PDP]

Next, a manufacturing method of the PDP according to the third embodiment will be described.

Since the front substrate forming step and the superposing step are the same as in the first embodiment, the explanation will be directed only to a rear substrate forming step.

The partition forming step in the rear substrate forming step is performed after the address electrode 121 is formed on the rear substrate 120 in the address electrode forming step and the address-electrode dielectric layer 122 is formed in the dielectric layer forming step.

In the partition forming step, the same processes as in the first embodiment are performed to provide the partition layer 323 including the recessed portion 323A, the first partition 324, the second partition 325, the extension 326 and the guide partition 327.

In the phosphor layer forming step, the phosphor layer (not shown) is formed by applying the phosphor paste.

As shown in FIG. 6, above the vicinity of a first end of the guide partition 327 (the first end being opposite to a second end that faces the second partition 325), the nozzle 200 is located at such a position as follows when the application is started: the position where the application gap P between the nozzle 200 and a top of the guide partition 327 is 1.5 times or less of the inner-diameter dimension D of the nozzle opening 201 and where the center of the nozzle opening 201 substantially coincides with the center line F.

Then, the nozzle 20 is moved in the width direction at a constant speed while injecting the phosphor paste at a constant predetermined injection amount.

At this time, the phosphor paste injected by the nozzle 200 contacts the guide partition 327. Due to the above-described effects, the phosphor paste is applied while maintaining the center of the application position to substantially coincide with the center line F when the nozzle 200 is moved.

Since the low wall portion 325A is provided to a part of the second partition 325, the phosphor paste does not flow into the recessed portion 123A in another line that is next thereto in the column direction when the nozzle 200 is moved across the second partition 325. Thus, the phosphor paste can be stably applied to the recessed portion 323A on the one line that is to be applied with the phosphor paste.

Even when the phosphor paste is applied in an increased amount due to the slowed movement speed of the nozzle at the time of starting and terminating the nozzle movement, the phosphor paste is not applied on the top side of the extension 326 because the width dimension T of the out-of-plane directional end of the extension 326 is 90 percent or less of the width dimension J of the in-plane directional end such that a volume between the extensions 326 becomes large.

Incidentally, in applying the phosphor paste, a plurality of nozzles 200 are simultaneously moved along the first partition 324, such that the phosphor pastes of plural colors are simultaneously applied.

Effects and Advantages of Third Embodiment

According to the above-described arrangement according to the third embodiment, the following effects and advantages are expected in addition to the effects and advantages (1), (2), (4) to (6) obtained in the first embodiment.

(8) The height dimension R of the out-of-plane directional end of the extension 326 is smaller than the height dimension S of the first partition 324.

With this arrangement, even if the phosphor layer is formed on the top side of the extension 326 with the phosphor paste during the phosphor layer forming step, the sum of the height dimension R from the address-electrode dielectric layer 122 to the top side of the partition end 326 and the dimension of the phosphor paste applied on the top is not larger than the height dimension S of the first partition 324, so that no gap is provided between the front substrate 110 and the rear substrate 120 in the display area 100A. Hence, no noise is generated by a resonance due to the discharge in the discharge space, whereby good images can be reproduced.

In addition, the height dimension R of the out-of-plane directional end is 94.8 percent or less of the height dimension S of the first partition 324. With this arrangement, even when the phosphor paste whose powder proportion to the solvent is 75 percent (a generally used phosphor paste) is applied on the top side of the extension 326, a sum of the height dimension R of the partition end 326 and the thickness dimension of the phosphor layer 127 does not exceed the height dimension S of the first partition 324, whereby a degradation of image quality due to a noise can be more reliably prevented.

(9) The width dimension T of the out-of-plane directional end of the extension 326 is equal to or smaller than the width dimension J (the width dimension of the first partition) of the in-plane directional end.

With this arrangement, even when the phosphor paste is injected in an amount more than the predetermined amount, for instance, due to a decrease in the speed of the nozzle 200 in applying the phosphor paste between the extensions 326 during the phosphor layer forming step, since the distance between the neighboring extensions 326 is large, the phosphor paste can be prevented from flowing onto the top side of the extension 326 to be applied thereto. Thus, the phosphor layer 326 can be prevented from being formed on the top side of the extension 126, and no gap is formed between the front substrate 110 and the rear substrate 120 in the display area 100A. Hence, no noise is generated by a resonance due to the discharge in the discharge space, whereby good images can be reproduced.

(10) The longitudinal length dimension Q of the extension 326 (the width direction of the PDP 100) is set to be larger than the transverse width I of the recessed portion 323A.

With this arrangement, when the nozzle 200 is started to be moved from between the neighboring extensions 326 disposed on the first portion of the non-display area 100B during the phosphor layer forming step, a sufficient acceleration distance for the nozzle 200 can be secured. Thus, when the phosphor paste is applied to the recessed portions 323A along the neighboring first partitions 324, the movement speed of the nozzle 200 can be reliably set to be constant, whereby the stable phosphor layer can be formed.

Other Embodiments

It should be noted that the present invention is not limited to the embodiments described above but includes modifications, improvements and the like within a scope where an object of the present invention can be achieved.

For instance, although the curb-shaped partition is formed in the rear substrate 120 by the first partition 125, 225, 324 and the second partition 126, 226, 325 that are perpendicular to each other in the first to third embodiments, the present invention is not limited thereto but may adopt an arrangement in which only the first partition 125, 225, 324 and the guide partition 127 form a striped partition.

Although the guide partition 127, 227, 327 longitudinally extends substantially along the center line F between the neighboring first partitions 125, 225, 324 in the first to third embodiments, the present invention is not limited thereto but may adopt an arrangement in which the guide partition longitudinally extends substantially along the center line between the neighboring second partitions 126, 226, 325 and the phosphor layer is formed along the center line.

Although the guide partition 127, 227, 327 longitudinally extends substantially along the center line F in the first to third embodiments, the guide portion may be provided on the center line F in a point-like shape.

Although the longitudinal length dimension B of the guide partition 127, 327 is exemplarily smaller than the transverse width I of the recessed portions 124A, 323A in the first and third embodiments, the length dimension B may be larger than the transverse width I.

Although the width dimension A of the guide partition 127 is exemplarily smaller than the width dimension J of the first partition 125 in the first embodiment, the width dimension A may be larger than the width dimension J.

Figure 10:
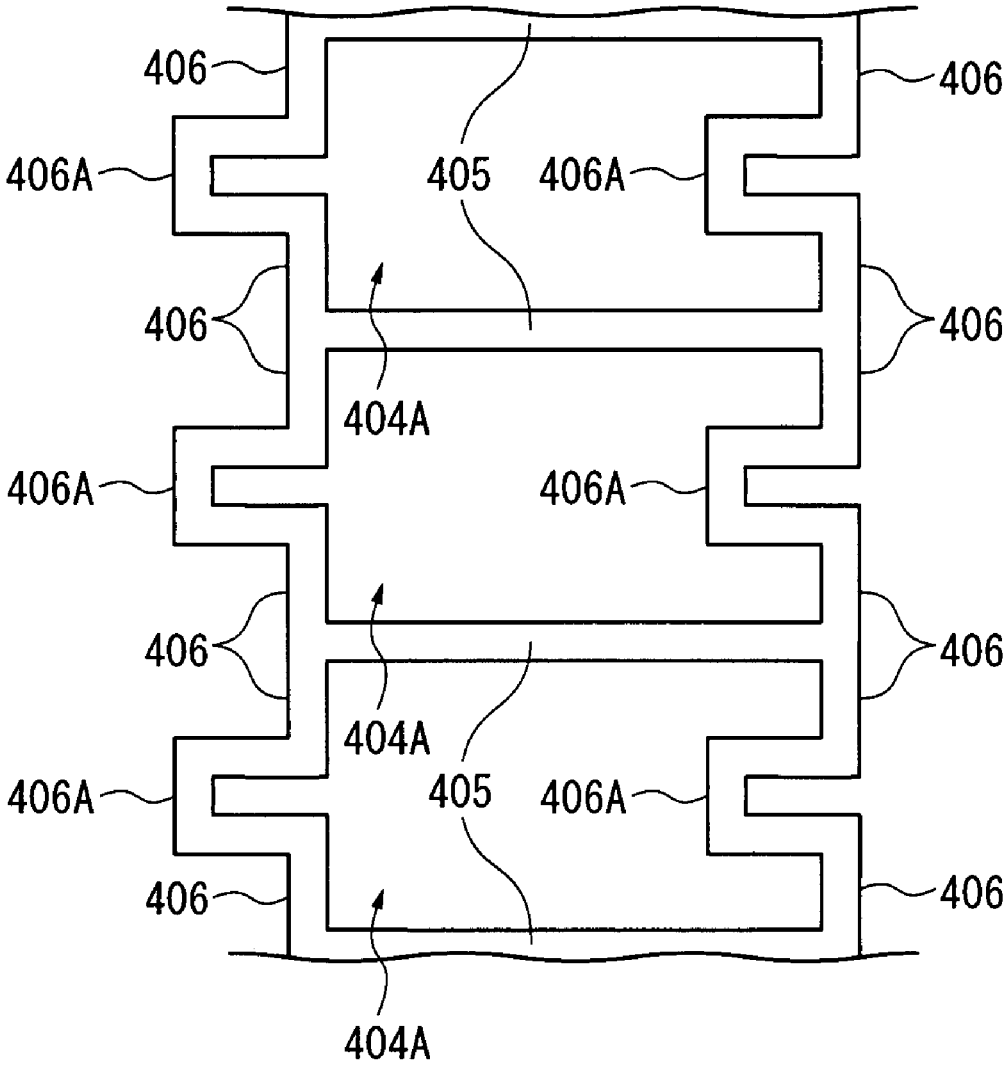
FIG. 10 is a plan view showing shapes of a first partition, a second partition and a recessed portion according to a fourth embodiment.
Figure 11:
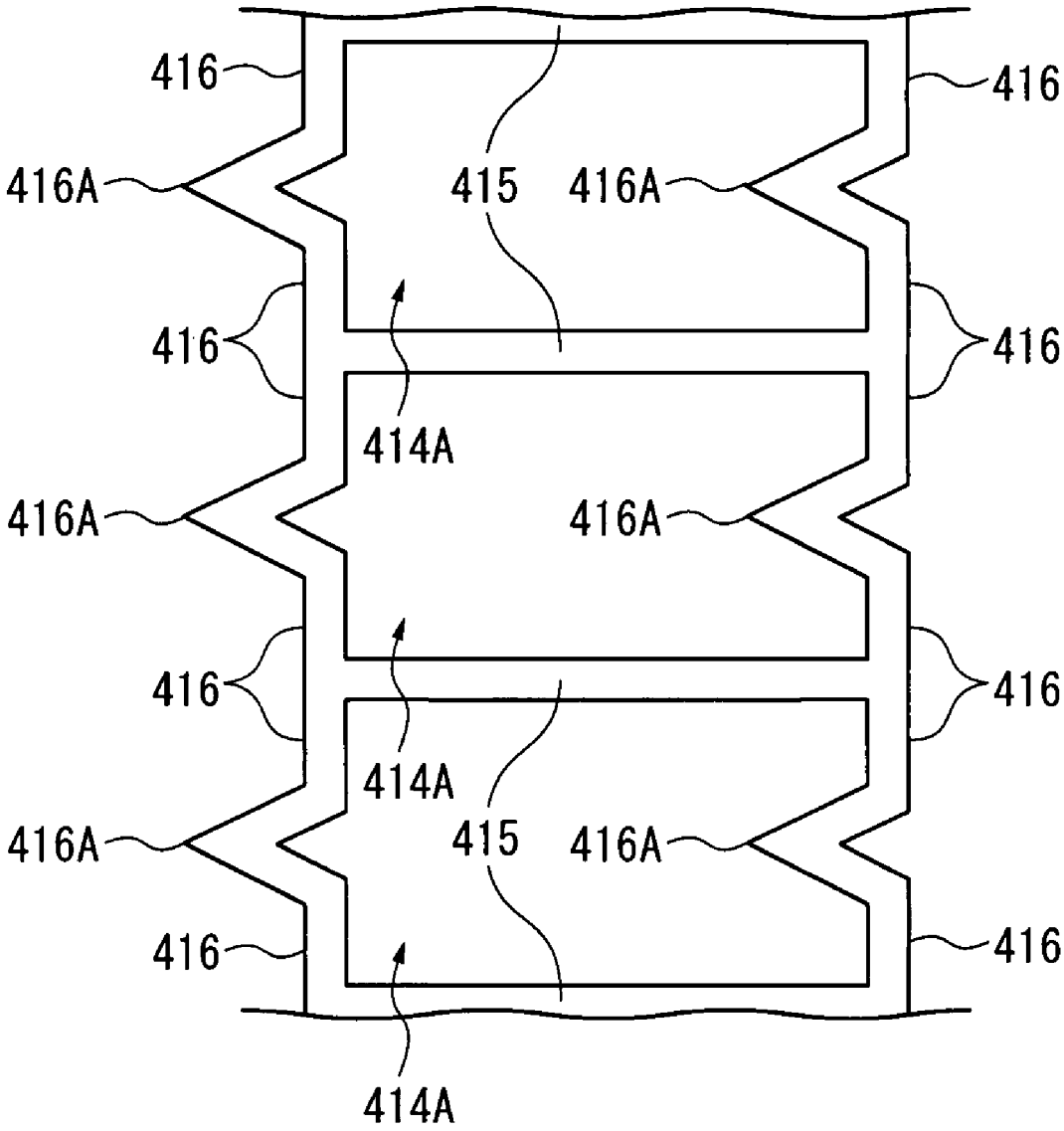
FIG. 11 is a plan view showing shapes of a first partition, a second partition and a recessed portion according to a fifth embodiment.
Figure 12:
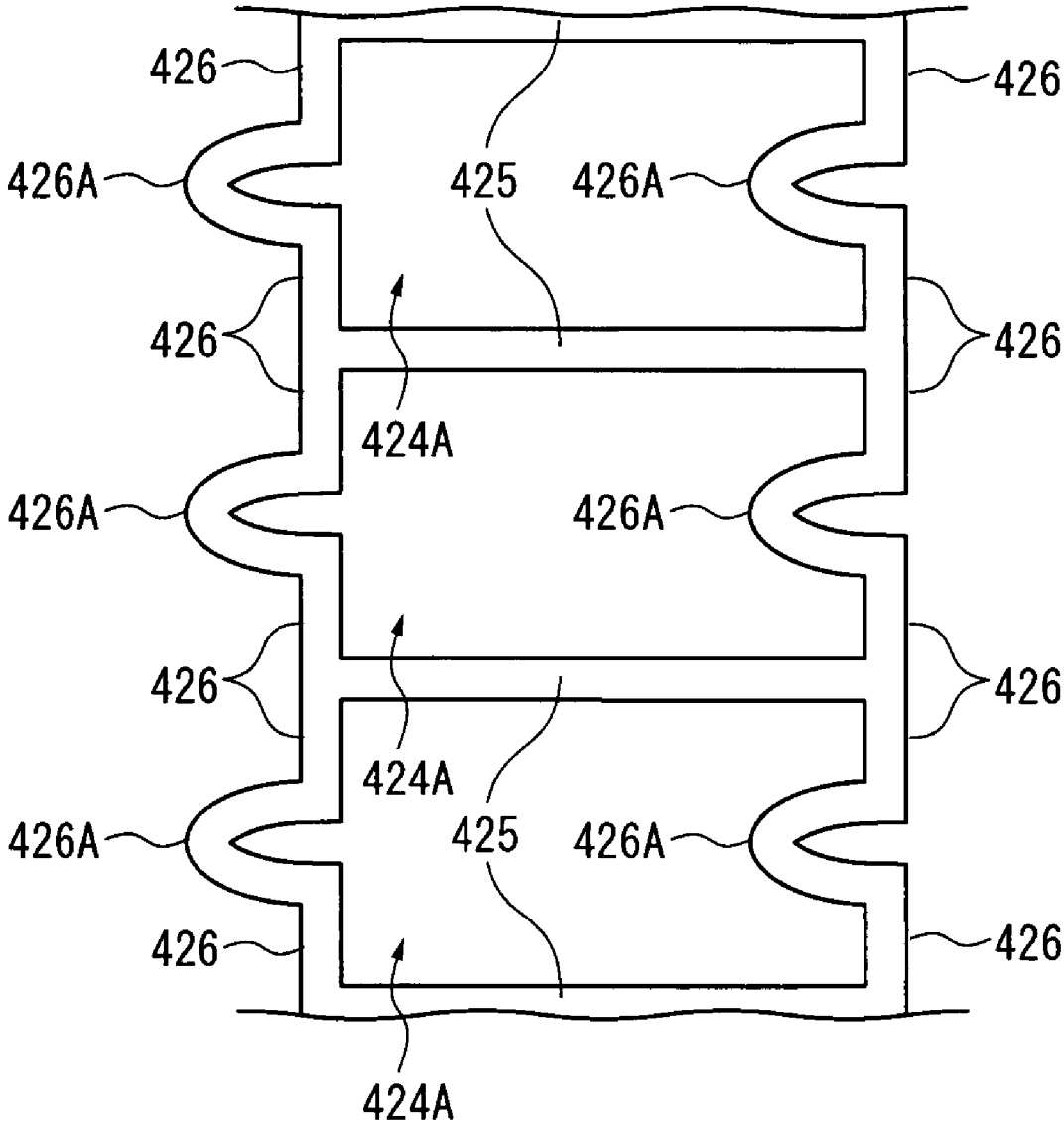
FIG. 12 is a plan view showing shapes of a first partition, a second partition and a recessed portion according to a sixth embodiment.

The first partition, the second partition and the recessed portion may be shaped as shown in FIGS. 10 to 12.

Arrangements shown in FIGS. 10 to 12 include first partitions 405, 415, 425 and second partitions 406, 416, 426. Recessed portions 404A, 414A, 424A are respectively defined by the first partitions 405, 415, 425 and the second partitions 406, 416, 426. The second partition 406 includes a bent portion 406A provided at a portion corresponding to substantially the center between the neighboring first partitions 405, the bent portion 406A being bent to protrude in a quadrangular shape in the width direction of the PDP. The second partition 416 includes a bent portion 416A provided at a portion corresponding to substantially the center between the neighboring first partitions 415, the bent portion 416A being bent to protrude in a triangular shape in the width direction of the PDP. The second partition 426 includes a bent portion 426A provided at a portion corresponding to substantially the center between the neighboring first partitions 425, the bent portion 426A being bent to protrude in a semielliptic shape in the width direction of the PDP.

With any of the above arrangements, the same effects and advantages as in the second embodiment can be obtained.

In addition, although the extension 326 is exemplarily configured such that the height dimension R of the out-of-plane directional end is smaller than the height dimension S of the in-plane directional end (the height dimension of the first partition 324) while the width dimension T of the out-of-plane directional end is smaller than the width dimension J of the in-plane directional end (the width dimension of the first partition 324) in the third embodiment, the extension 326 may be configured to, for example, satisfy either one of the above-described conditions. Specifically, the extension 326 may be configured such that the height dimension R of the out-of-plane directional end is smaller than the height dimension S of the in-plane directional end while the width dimensions of the out-of-plane directional end and the in-plane directional end are substantially the same. Conversely, the extension 326 may be configured such that the width dimension T of the out-of-plane directional end is smaller than the width dimension J of the in-plane directional end while the height dimensions of the out-of-plane directional end and the in-plane directional end are substantially the same.

Although the first to third embodiments exemplarily show the arrangement in which the phosphor pastes of plural colors are simultaneously applied using the plurality of nozzles 200, a phosphor paste of one color may be applied using one nozzle 200 or a phosphor paste of one color may be applied to plural portions using the plurality of nozzles 200.

Although the application of the phosphor paste is exemplarily started after the nozzle 200 is positioned at the position where the application gap P is 1.5 times or less of the inner-diameter dimension D of the nozzle opening 201 in the first to third embodiments, the application of the phosphor paste may be started after the nozzle 200 is positioned at a position where the application gap P is more than 1.5 times of the inner-diameter dimension D.

Effects and Advantages of Embodiments

As described above, in the PDP 100 according to the embodiments, the guide partition 127 is provided to be located on the center line F between the pair of first partitions 125 at the position spaced apart from the end of the first partition 125 by the distance H. The end of the phosphor layer 128 is formed on the guide partition 127.

With this arrangement, the phosphor paste injected from the nozzle 200 when the application is stared in the phosphor forming step contacts the guide partition located closer to the nozzle 200 than the address-electrode dielectric layer 122, whereby the end of the phosphor layer 128 can be formed on the guide partition 127. Accordingly, the phosphor paste can bridge between the nozzle 200 and the rear substrate 120 quickly as compared with a conventional arrangement in which the application is started after the phosphor paste directly contacts the rear substrate 120. Hence, the phosphor paste can bridge between the nozzle 200 and the rear substrate 120 quickly without performing such a complex control as to approximate the nozzle 200 to the rear substrate 120 when the application is started or to increase the injection amount only when the application is started.

By utilizing the characteristic where the application position E of the phosphor paste is stabilized once the phosphor paste bridges between the nozzle 200 and the rear substrate 120, the center of the application position E can be positioned at the position where the center of the application position E substantially coincides with the center line F. The nozzle 200 can apply the phosphor paste while maintaining the center of the application position E to substantially coincide with the center line F during the moving operation. Accordingly, without correcting a position of the nozzle 200 in a right-and-left direction relative to the moving direction of the nozzle 200, the center of the application position E can substantially coincide with the center line F.

Thus, accuracy in applying the phosphor paste can be easily enhanced.

The priority application Number JP2007-018834 upon which this patent application is based is hereby incorporated by reference.

What is claimed is:

1. A display panel, comprising:

a pair of substrates disposed to face each other with a discharge space being interposed;

partitions that partition the discharge space into display cells, the partitions being provided to at least one of the pair of substrates to be longitudinally formed between ends of the at least one of the pair of substrates; and a phosphor layer that emits light due to discharge in the discharge space, the phosphor layer being formed between the partitions, wherein a display area in which images are displayed by light emitting of the phosphor layer due to the discharge is provided in an in-plane side of the at least one of the substrates while a non-display area is provided at a peripheral end of the at least one of the substrates, each of the partitions includes: a first partition that partitions the discharge space in a first direction; and a second partition that partitions the discharge space in a second direction substantially perpendicular to the first direction, a guide partition is provided at a position spaced apart by a predetermined distance from an end of each of the partitions provided at positions corresponding to the non-display area, the guide partition being positioned on a center line between the first partitions, and an end of the phosphor layer is provided on the guide partition.

2. The display panel according to claim 1, wherein the guide partition extends substantially along the center line between the first partitions.

3. The display panel according to claim 1, wherein a length dimension of the guide partition in a direction substantially along the center line is smaller than a dimension of a gap between the second partitions.

4. The display panel according to claim 1, wherein a width dimension of the guide partition in a direction perpendicular the direction substantially along the center line is smaller than a width dimension of the first partition.

5. The display panel according to claim 1, wherein the end of each of the partitions provided at the positions corresponding to the non-display area is formed by an extending portion that extends substantially along the first direction on an extension of the first partition, and a height dimension of the extending portion of the first partition is equal to or smaller than a height dimension of each of the partitions provided at positions corresponding to the display area, the height dimensions being dimensions of heights from the at least one of the pair of substrates.

6. The display panel according to claim 5, wherein a width dimension of an end of the extending portion of the first partition is equal to or smaller than a width dimension of each of the partitions provided at the positions corresponding to the display area, the width dimensions being dimensions of widths substantially perpendicular to a longitudinal direction of the partitions.

7. The display panel according to claim 5, wherein a length dimension of the extending portion of the first partition is larger than the dimension of the gap between the second partitions, the length dimension being a dimension of a length substantially parallel to the longitudinal direction.

8. The display panel according to claim 1, wherein the second partition includes a bent portion that is bent to protrude in the first direction at a portion corresponding to substantially a center between the first partitions, the first partitions neighboring each other and forming a pair.

9. The display panel according to claim 1, wherein the phosphor layer includes a plurality of partial phosphor layers of respectively different colors, and each of the partial phosphor layers is continuously formed substantially along the first direction between the first partitions.

10. The display panel according to claim 1, wherein the second partition includes a low partition portion between the first partitions that neighbor each other, a height dimension of the low partition portion being lower than a height dimension of the first partition, the height dimensions being dimensions of heights from the at least one of the pair of substrates.

* * * * *